US008151994B2

(12) United States Patent
Carr et al.

(10) Patent No.: US 8,151,994 B2
(45) Date of Patent: Apr. 10, 2012

(54) SUPERIMPOSED MOTION DRIVE

(75) Inventors: Brian S. Carr, Burlington, KY (US); Michael A. Timmerman, Cincinnati, OH (US)

(73) Assignee: M-I L.L.C., Houston, TX (US)

( * ) Notice: Subject to any disclaimer, the term of this patent is extended or adjusted under 35 U.S.C. 154(b) by 465 days.

(21) Appl. No.: 11/861,940

(22) Filed: Sep. 26, 2007

(65) Prior Publication Data

US 2008/0237095 A1 Oct. 2, 2008

Related U.S. Application Data

(60) Provisional application No. 60/827,524, filed on Sep. 29, 2006.

(51) Int. Cl.
*B07B 1/36* (2006.01)

(52) U.S. Cl. ..... 209/325; 209/326; 209/331; 209/365.1

(58) Field of Classification Search ..... 209/325, 209/326, 331, 357, 358, 360, 364, 365.1
See application file for complete search history.

(56) References Cited

U.S. PATENT DOCUMENTS

| | | | | |
|---|---|---|---|---|
| 2,880,871 | A * | 4/1959 | Bruninghaus | 209/310 |
| 3,954,604 | A * | 5/1976 | Krause et al. | 209/325 |
| 5,199,574 | A | 4/1993 | Hollyfield, Jr. et al. | |
| 5,232,099 | A * | 8/1993 | Maynard | 209/311 |
| 6,513,664 | B1 | 2/2003 | Logan et al. | |
| 6,845,868 | B1 * | 1/2005 | Krush et al. | 209/365.4 |
| 7,571,817 | B2 * | 8/2009 | Scott et al. | 209/413 |
| 2005/0072717 | A1 * | 4/2005 | Purohit et al. | 209/309 |
| 2005/0242003 | A1 * | 11/2005 | Scott et al. | 209/363 |

FOREIGN PATENT DOCUMENTS

| | | |
|---|---|---|
| KR | 1020010088626 | 9/2001 |
| KR | 100557250 | 3/2006 |

OTHER PUBLICATIONS

PCT International Search Report issued in PCT Application No. PCT/US2007/079226 dated Mar. 13, 2008 (4 pages).

PCT Written Opinion issued in PCT Application No. PCT/US2007/079226 dated Mar. 13, 2008 (5 pages).

English Patent Abstract of KR 10-0557250 from the Korean Patent Office website (2 pages) Inventor: Kim, Won Keuk Publication Date: Feb. 24, 2006.

English Patent Abstract of KR 10-2001-0088626 from the Korean Patent Office website (1 page) Inventor: Lee, Seong Min Publication Date: Sep. 28, 2001.

* cited by examiner

*Primary Examiner* — Joseph C Rodriguez

(74) *Attorney, Agent, or Firm* — Kimberly D. Ballew; Sara K. M. Hinkley; Patrick A. Traister

(57) ABSTRACT

A vibratory separator including a frame, a screen configured to connect to the frame, a first actuator coupled to the frame, and a second actuator coupled to the frame, wherein the first actuator imparts a high frequency motion to the frame, and wherein the second actuator imparts a low frequency acceleratory motion to the frame is disclosed. Also, a method for processing drilling waste including imparting a low frequency acceleratory motion to a frame of a vibratory separator and imparting a high frequency motion over the low frequency acceleratory motion is also disclosed.

26 Claims, 9 Drawing Sheets

SUPERIMPOSED MOTION DRIVE

CROSS-REFERENCE TO RELATED APPLICATIONS

This application, pursuant to 35 U.S.C. §119(e), claims priority to U.S. Provisional Application Ser. No. 60/827,524, filed Sep. 29, 2006. That application is incorporated by reference in its entirety.

BACKGROUND

1. Field of the Disclosure

The present disclosure generally relates to methods and apparatuses for separating solids from liquids. More specifically, the present disclosure relates to apparatuses and methods for superimposing a high frequency motion over a low frequency motion, and imparting the resultant motion to drilling material on a vibratory separator.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. Typically, the shale shaker is an angled table with a generally perforated filter screen bottom. Returning drilling fluid is deposited at the feed end of the shale shaker. As the drilling fluid travels down the length of the vibrating table, the fluid falls through the perforations to a reservoir below leaving the solid particulate material behind. The vibrating action of the shale shaker table conveys solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling fluid flow rates and particulate percentages in the drilling fluid. After the fluid passes through the perforated bottom of the shale shaker, it can either return to service in the borehole immediately, be stored for measurement and evaluation, or pass through an additional piece of equipment (e.g., a drying shaker, centrifuge, or a smaller sized shale shaker) to further remove smaller cuttings.

Currently, when a drilling operator chooses a separatory profile, therein selecting a type of motion that actuators of the vibratory separator will provide to the screen assemblies, they typically choose between a profile that either processes drilling material quickly or thoroughly. It is well known in the art that providing linear motion increases the G-forces acting on the drilling material, thereby increasing the speed of conveyance and enabling the vibratory separator to process heavier solids loads. By increasing the speed of conveyance, linear motion vibratory shakers provide increased shaker fluid capacity and increased processing volume. However, in certain separatory operations, the weight of solids may still restrict the speed that linear motion separation provides. Additionally, while increased G-forces enable faster conveyance, as the speed of conveyance increases, there is a potential that the produced drill cuttings may still be saturated in drilling fluid.

Alternatively, a drilling operator may select a vibratory profile that imparts lower force vibrations onto the drilling material, thereby resulting in drier cuttings and increased drilling fluid recovery. However, such lower force vibrations generally slow drilling material processing, thereby increasing the time and cost associated with processing drilling material.

Accordingly, there exists a need for a vibratory shaker that produces drier cuttings and increases drilling fluid recovery while increasing processing time.

SUMMARY OF THE DISCLOSURE

In one aspect, embodiments disclosed herein relate to a vibratory separator including a frame, a screen configured to connect to the frame, a first actuator coupled to the frame, and a second actuator coupled to the frame, wherein the first actuator imparts a high frequency motion to the frame, and wherein the second actuator imparts a low frequency acceleratory motion to the frame.

In another aspect, embodiments disclosed herein relate to a method for processing drilling waste including imparting a low frequency acceleratory motion to a frame of a vibratory separator and imparting a high frequency motion over the low frequency acceleratory motion.

Other aspects and advantages of the invention will be apparent from the following description and the appended claims.

DETAILED DESCRIPTION

Figure 1:
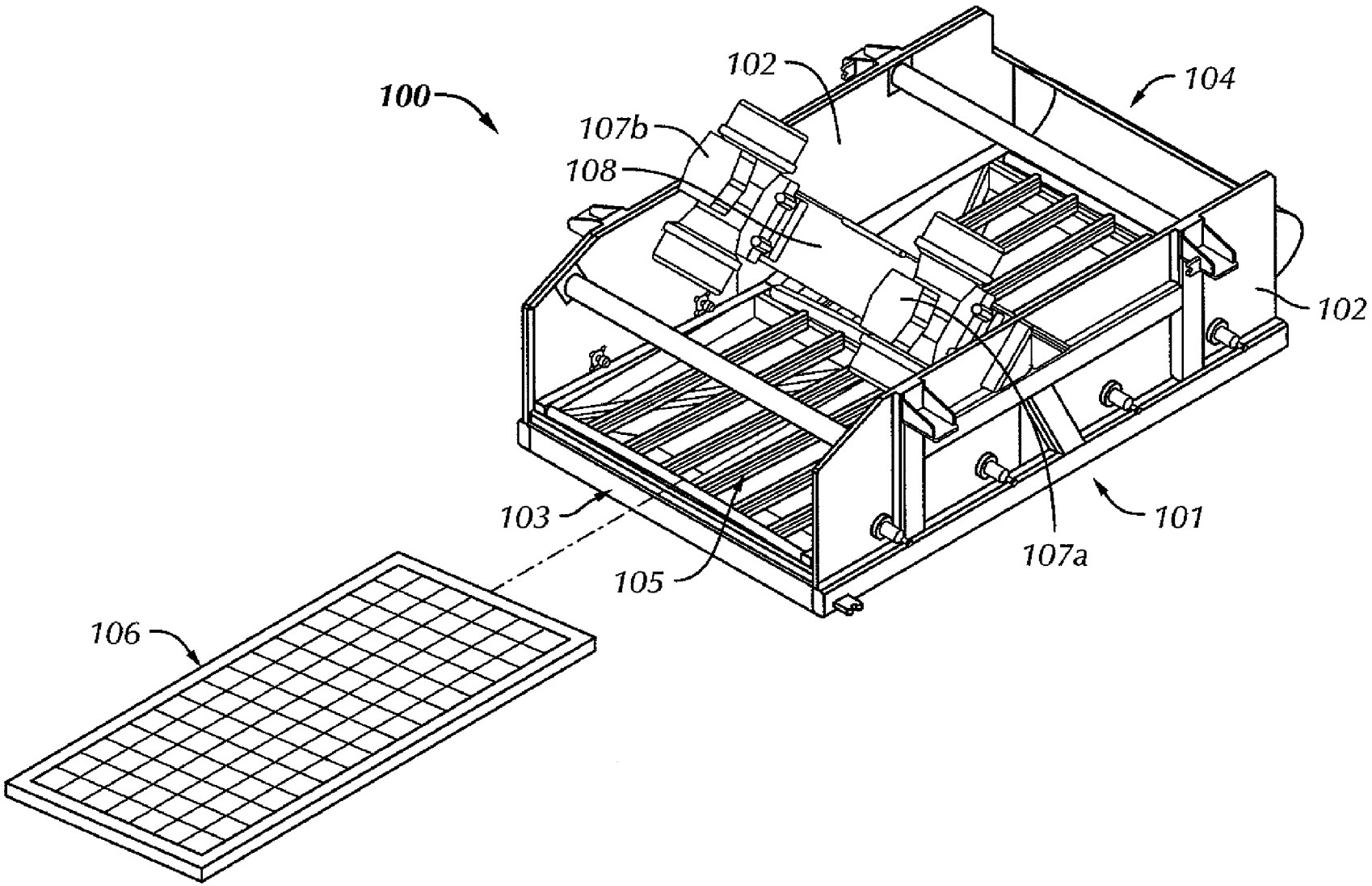
FIG. 1 is an isometric view of a vibratory separator in accordance with an embodiment of the present disclosure.
Figure 2:
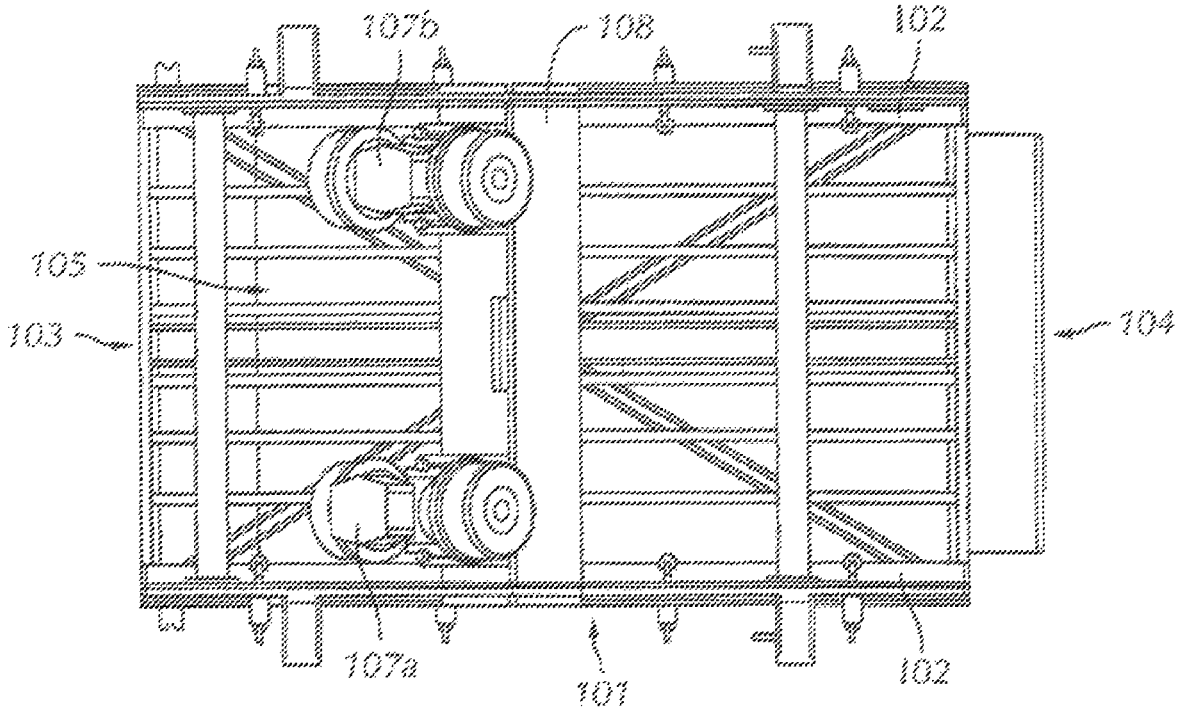
FIG. 2 is a top view of a vibratory separator in accordance with an embodiment of the present disclosure.
Figure 3:
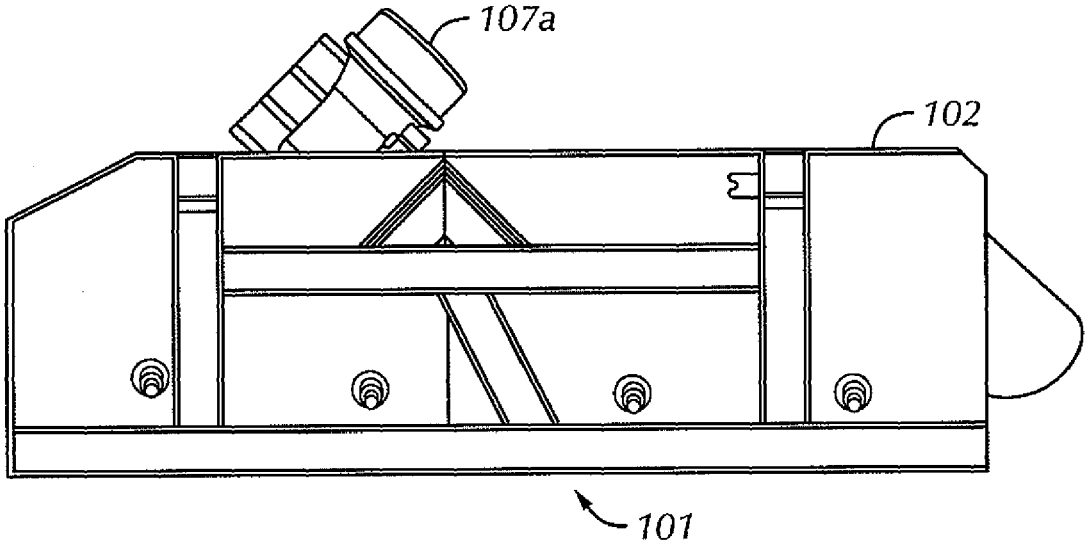
FIG. 3 is a side view of a vibratory separator in accordance with an embodiment of the present disclosure.
Figure 4:
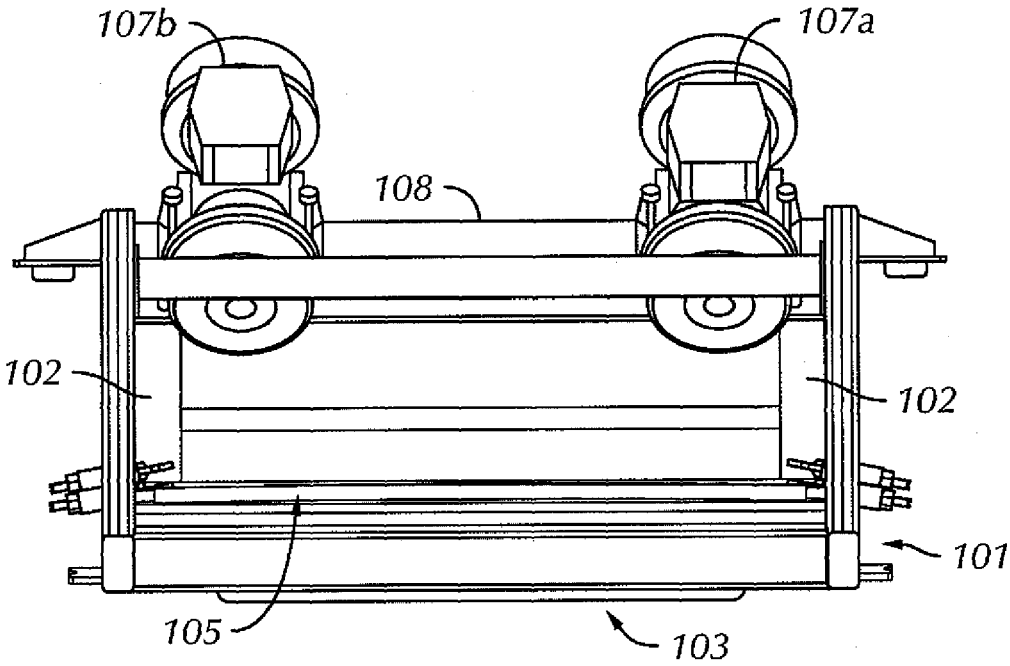
FIG. 4 is a front view of a vibratory separator in accordance with an embodiment of the present disclosure.

Generally, embodiments disclosed herein relate to apparatuses and methods for separating solids from liquids. Specifically, embodiments disclosed herein relate to apparatuses and methods for superimposing a high frequency motion over a low frequency motion, and imparting the resultant motion to drilling material on a vibratory separator.

Referring initially to FIGS. 1-4, isometric, top, side and front views of a vibratory separator 100 in accordance with an embodiment of the present disclosure are shown. In this embodiment, vibratory separator 100 includes a frame 101, side walls 102, a discharge end 103, and an inlet end 104. Vibratory separator 100 also includes a basket 105 that holds a screen assembly 106. Operationally, as drilling material enters vibratory separator 100 through inlet end 104, the drilling material is moved along screen assembly 106 by a vibratory motion. As screen assembly 106 vibrates, residual drilling fluid and particulate matter may fall through screen assembly 106 for collection and recycling, while larger solids are discharged from discharge end 103.

In one embodiment, vibratory motion is supplied by a plurality of actuators 107*a* and 107*b* coupled to a support member 108 for imparting the vibratory motion to basket 105. Actuators 107 are driven by rotary motors (not shown) having shafts (not shown) coupled to identical unbalanced weights (not shown) attached to opposite ends of the shafts. The rotary motors may be operatively connected to a programmable logic controller ("PLC") (not shown) that may supply instructions to the motors, actuators 107, or other components of vibratory separator 100. The instructions to the motors and/or actuators 107 may include vibratory motion protocols that define a pattern of movement for moving basket 105 and/or frame 101. However, those of ordinary skill in the art will appreciate that PLCs are not a requirement for all applications, and as such, actuators may be independently controllable with or without a PLC.

Figure 5:
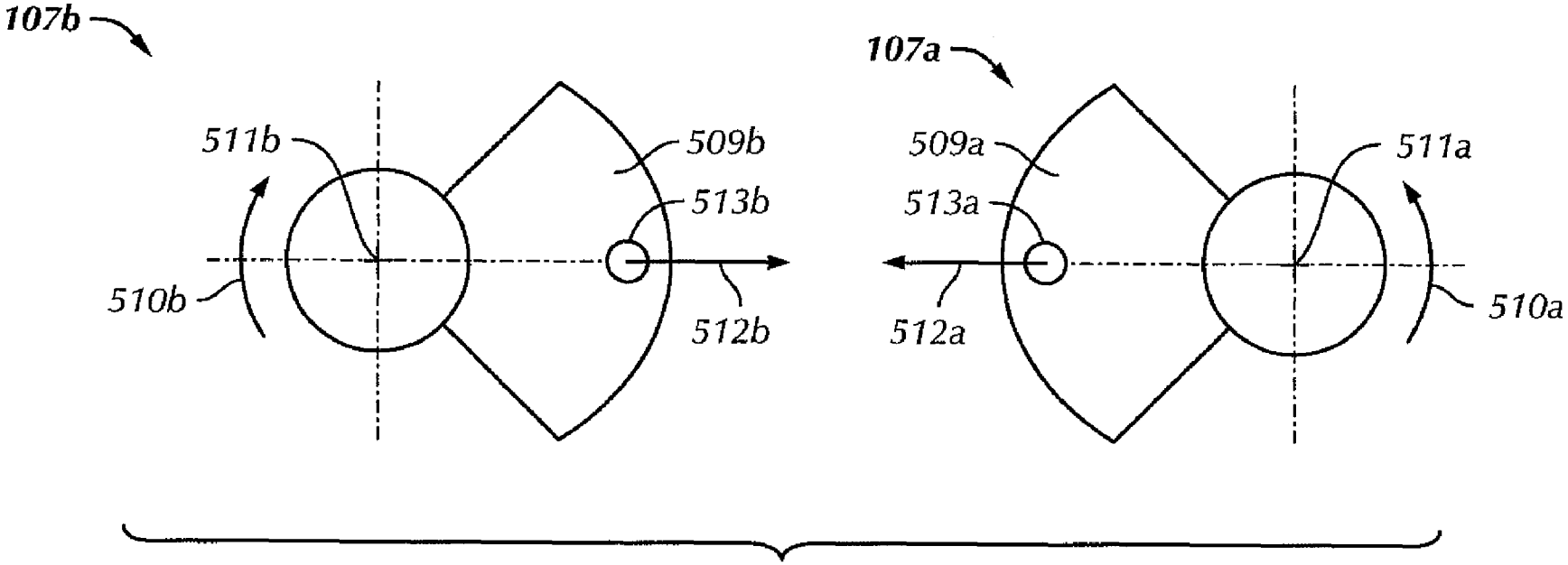
FIG. 5 is a schematic view of a rotational motion of actuators in accordance with a n embodiment of the present disclosure.

Referring now to FIG. 5, a schematic view of a rotational motion of actuators during operation of a vibratory separator in accordance with one embodiment of the present disclosure is shown. In this embodiment, the instructions from the PLC to the motors may define a pattern of movement that constitutes a linear motion. In such an embodiment, the motors may drive actuators 107*a* and 107*b* thereby rotating unbalanced weights 509*b* and 509*a* in opposite directions 510*b* and 510*a* around their respective axes of rotation 511*b* and 511*a*. The rotation of unbalanced weights 509*b* and 509*a* produces centrifugal forces 512*b* and 512*a* as the centers of mass 513*b* and 513*a* rotate in equal planes relative to their respective axes of rotation 511*b* and 511*a*.

Figure 6:
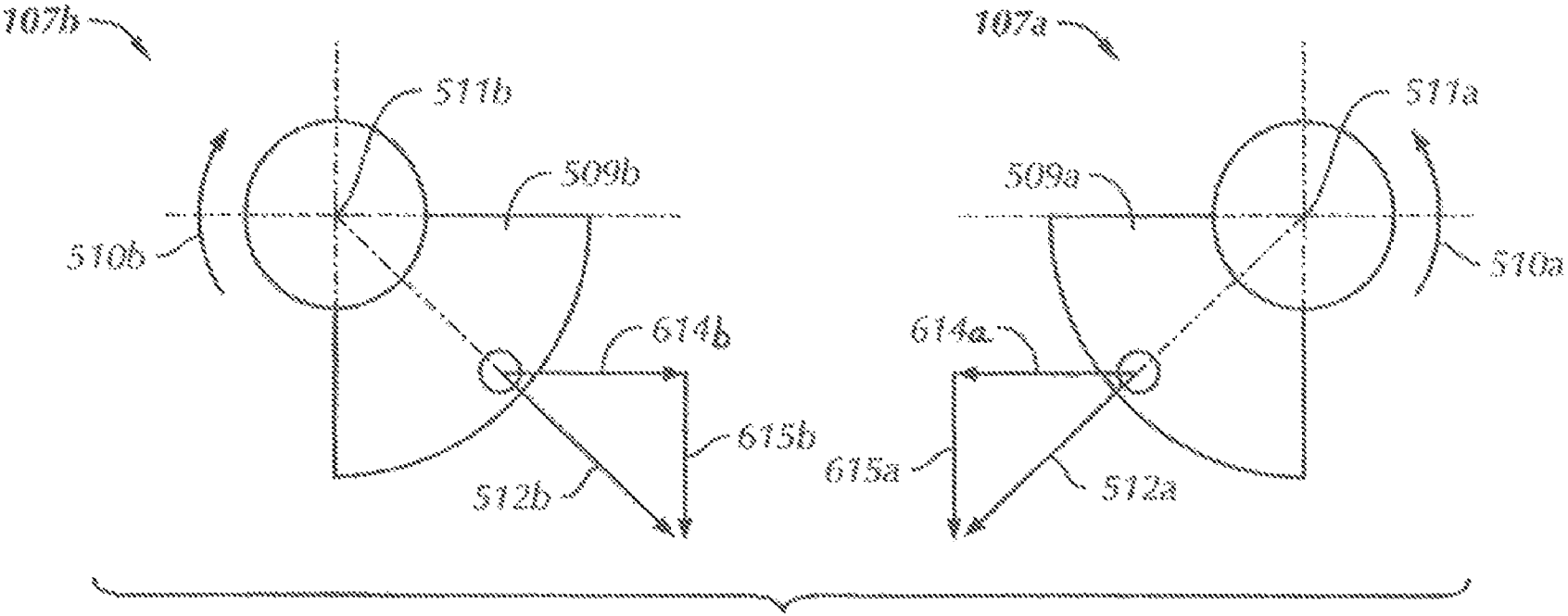
FIG. 6 is a schematic view of forces produced by the rotational motion of actuators during operation of the vibratory separator of FIG. 5.

Referring to FIG. 6, a schematic view of forces produced by rotational motion of the actuators during operation of the vibratory separator of FIG. 5 is shown. As unbalanced weights 509*b* and 509*a* rotate around their respective axis 511*b* and 511*a*, centrifugal forces 512*b* and 512*a* may impart a linear motion to a frame and/or basket of a vibratory separator. In this embodiment, centrifugal forces 512*b* and 512*a* include horizontal components 614*b* and 614*a* and vertical components 615*b* and 615*a*. Because the direction and speed of rotation of unbalanced weights 509*b* and 509*a* are opposite and equal, horizontal components 614*b* and 614*a* cancel one another. As a result, the only forces acting on the frame and/or basket of the vibratory separator are the sum of the vertical components 615*b* and 615*a*. Because the sum of vertical components 615*b* and 615*a* vary from a positive maximum value to a negative maximum value, the motion imparted to the frame and/or basket is linear and reciprocating. Thus, as the frame and/or basket of the vibratory separator moves in accordance with the motion provided by actuators 107, the vibratory motion imparted to a corresponding screen assembly may be varied according to the rotational velocity of actuators 107.

In one embodiment, as the rotational velocity of actuators 107 is increased, the vibratory speed of the screen assembly is increased. To provide a linear motion to the screen assembly that effectively shears drilling material, a high frequency force is preferable. In one embodiment, to provide a high frequency linear force to shear the drilling material, the motors may operate in a range of 3000 to 6000 revolutions per minute ("RPM"). However, one of ordinary skill in the art will appreciate that depending on specific design variables of vibratory separators (e.g., belt configuration and motor size) and operational parameters (e.g., drilling material viscosity), the operational speed of the motors may be varied accordingly.

While a single linear motion may be used to effectively shear the drilling material, providing additional low frequency forces superimposed with the high frequency force may further increase the conveyance of the drilling material. In one embodiment, an additional linear force may be imparted to the frame and/or basket of a vibratory separator to further enhance the conveyance of the drilling material.

Figure 7:
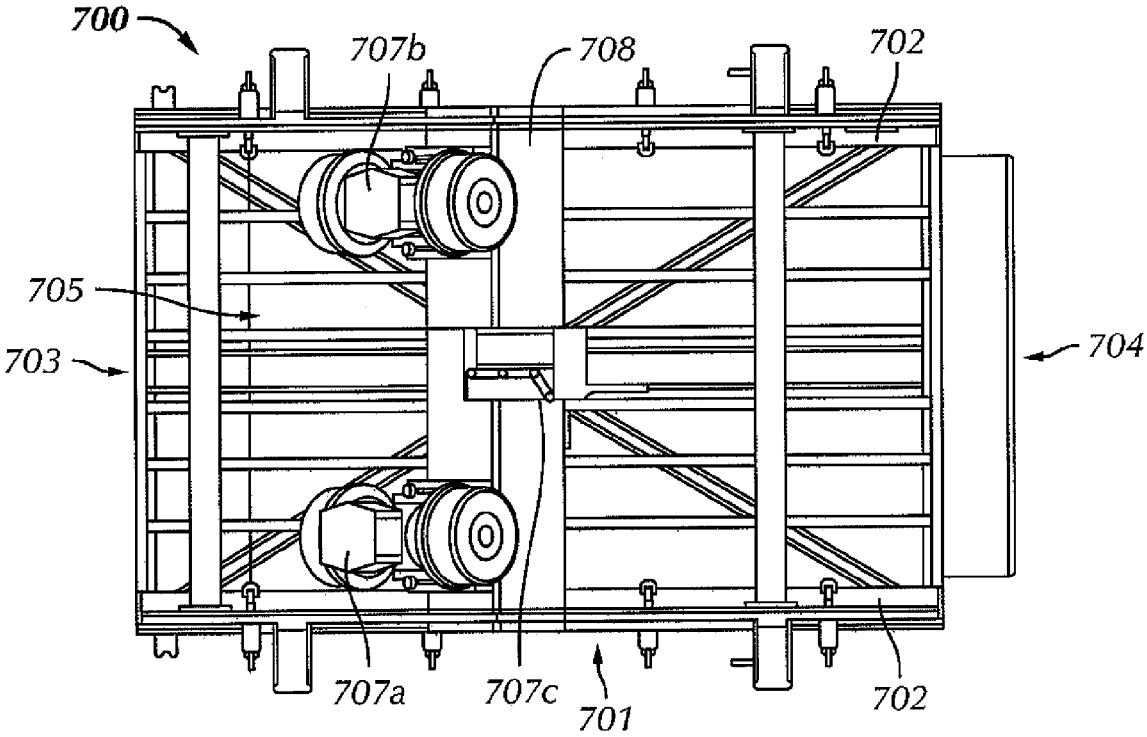
FIG. 7 is a top view of a vibratory separator in accordance with an embodiment of the present disclosure.

Referring to FIG. 7, a top view of a vibratory separator in accordance with an embodiment of the present disclosure is shown. In this embodiment, vibratory separator 700 includes a frame 701, side walls 702, a discharge end 703, and an inlet end 704. Vibratory separator 700 also includes a basket 705 and a plurality of actuators 707. Actuators 707*a* and 707*b* may operate as described above to impart a linear motion to frame 701 and/or basket 705. In one embodiment, vibratory separator 700 includes a third actuator 707*c* to provide an acceleratory motion to frame 701. In this embodiment, actuator 707*c* is disposed on vibratory separator 700 to provide an additional linear acceleratory motion to frame 701 and/or basket 705.

Operationally, actuator 707*c* may be coupled to a rotary motor (not shown) which may then be coupled to a rotary shaft (not shown). The rotary shaft may then be coupled to one or more unbalanced weights as described above. Upon activation, the third rotary motor may provide motion to actuator 707*c*, which may then impart a linear motion to frame 701 and/or basket 705.

Figure 8:
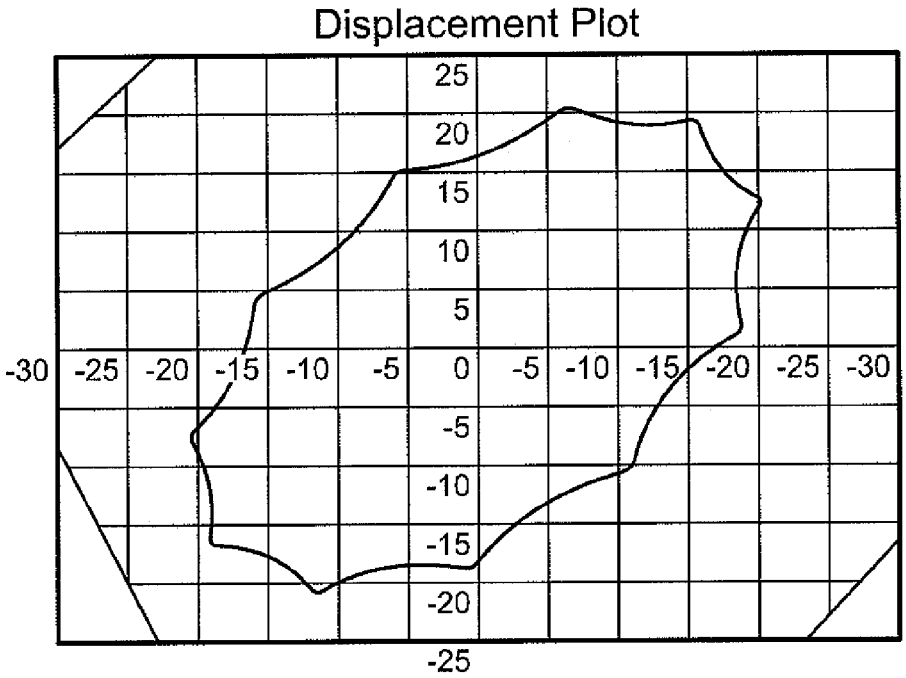
FIG. 8 is a displacement plot of a high frequency force superimposed over a low frequency force in accordance with an embodiment of the present disclosure.

In one embodiment of the present disclosure, the linear forces provided by actuator 707*c* may provide an acceleratory motion contemporaneous with the linear motion of actuators 707*a* and 707*b*. That is, the acceleratory motion may constitute a low frequency force (i.e., a long stroke). Additionally, a high frequency force (i.e., short stroke), provided by actuators 707*a* and 707*b*, may be superimposed over the low frequency force. Referring briefly to FIG. 8, a displacement plot of a high frequency force superimposed over a low frequency force is shown. The displacement plot illustrates the reciprocating liner motion of the high frequency force over time with incremental spikes in acceleration due to the addition of a low frequency force. The low frequency force shows up on the displacement plot as incremental spikes, and in practice, results in a momentary increase in linear force that may enhance drilling material conveyance.

By adding an acceleratory motion to existing linear motion, drilling material conveyance across shaker screens may be increased due to an increase in G-forces. However, because the increase in G-force is incremental relative to the constant linear force acting upon the screen assemblies, the high frequency shearing forces may still act on the drilling material for a substantial period of time. Thus, the speed by which drilling material may be separated may be increased, because the high frequency shearing forces may work constantly on the drilling material, while the added low frequency acceleratory force is added to speed conveyance. Because shearing force may be increased without decreasing conveyance time, more drilling material may be processed without decreasing the quality of the cleaned cuttings and drilling fluid.

Those of ordinary skill in the art will appreciate that varied combinations of motion may be superimposed to generate a desired resultant motion. For example, in one embodiment, a high frequency round (i.e., circular) motion may be superimposed over a low frequency linear motion. In other embodiments, a high frequency round motion may be superimposed over a low frequency elliptical motion. In such embodiments, the motors imparting the high frequency round motion may operate in a 3000 to 6000 RPM range, while the motors imparting the low frequency linear or elliptical motion may operate in the 900 to 2200 RPM range. Those of ordinary skill in the art will further appreciate that the types of motion used for both the low frequency and/or the high frequency may be varied without departing from the scope of the present disclosure. Furthermore, in certain embodiments, the motors may operate in ranges outside of the above listed ranges when imparting such motion, and still fall within the scope of the disclosure.

Figure 9:
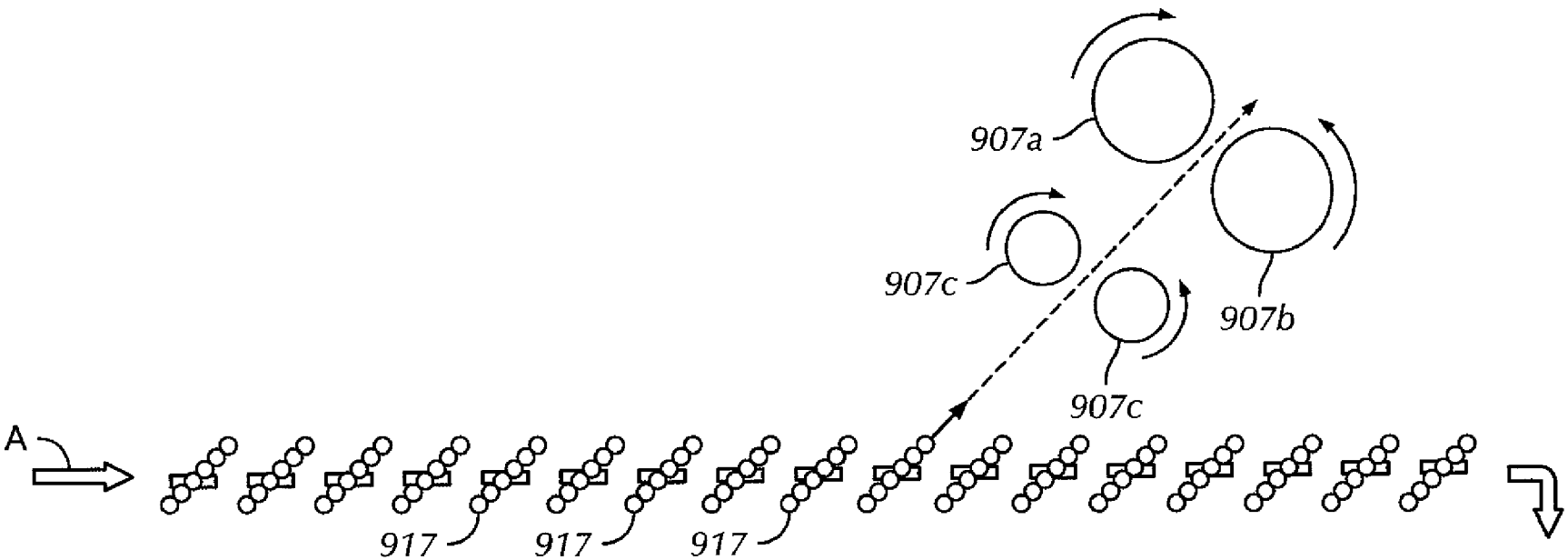
FIG. 9 is a schematic of a high frequency force superimposed over a low frequency force in accordance with an embodiment of the present disclosure.

Referring now to FIG. 9, a schematic of a high frequency linear force superimposed over a low frequency force in accordance with an embodiment of the present disclosure is shown. In this embodiment, actuators 907*a* and 907*b* are shown in motion, as described above. The linear force applied to the screen assembly is high frequency, and thus relatively constant. However, the acceleratory force is low frequency, and thus relatively incremental. As actuators 907*c* rotate, their acceleratory force may be incrementally added to the forces generated by actuators 907*a* and 907*b*, thereby resulting in a resultant motion shape 917. In this embodiment, the actuators generating the high frequency force are operating at about 3000 RPMs, while the actuators imparting the low frequency force are operating at about 1000 RPMs, as is evidenced by resultant motion shape 917. The resultant motion shape 917 is thus imparted to the basket and/or the frame, and subsequently the screen of the vibratory separator.

In one embodiment of the present disclosure, the acceleratory motion applied to the frame and/or basket may be generated by at least one rotary motor. Generally, the motor that generate the low frequency motion will operate at a lower RPM than the motor generating the high frequency motion. As previously discussed, the high frequency motor may preferably operate in a range of 3000 to 6000 RPM however, the motor generating the low frequency motion may operate in a range of 900 to 2200 RPM. By increasing the operating RPM of the third motor, the low frequency motion may thereby provide the acceleratory motion to the frame, basket, and/or screen assembly. While the above listed operational motor ranges may be preferable in certain embodiments, one of ordinary skill in the art will appreciate that any operable motor speeds capable of generating a low frequency acceleratory motion may be used. As such, the ranges provided are merely explanatory, and are in no way meant to limit the scope of the present disclosure. In fact, in certain embodiments, the rotational speed of the motor providing the low frequency acceleratory motion may operate at substantially lower RPM, or even at the same RPM as the motors generating the high frequency motion.

While the above listed embodiments describe vibratory separators wherein the high frequency force results in a linear motion, one of ordinary skill in the art will appreciate that the high frequency force may also include other commonly known shearing motions, such as, for example, an elliptical motion.

Figure 10:
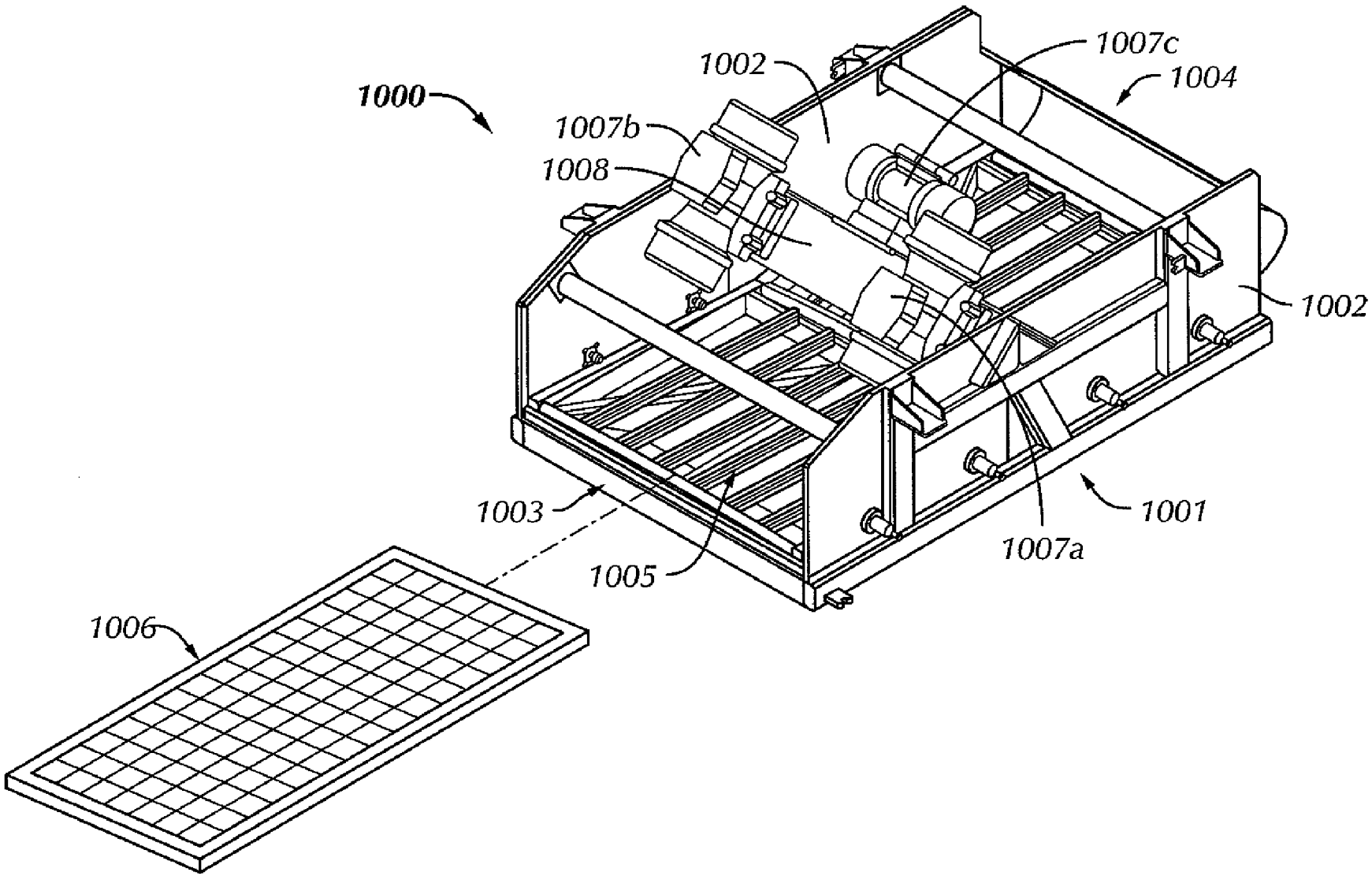
FIG. 10 is an isometric view of a vibratory separator in accordance with an embodiment of the present disclosure.

Referring to FIG. 10, a vibratory separator 1000 in accordance with an embodiment of the present disclosure is shown. In this embodiment, vibratory separator 1000 includes a frame 1001, side walls 1002, a discharge end 1003, and an inlet end 1004. Vibratory separator 1000 also includes a basket 1005 that holds a screen assembly 1006. As described above, vibratory separator includes a plurality of actuators 1007, wherein actuators 1007*a* and 1007*b* are configured to impart a linear motion to the frame and/or basket. However, vibratory separator 1000 also includes horizontally opposed actuator 1007*c* for the impartation of elliptical motion to the frame and/or basket. Elliptical motion in vibrating screen separators is described in detail in U.S. Pat. No. 6,513,664 titled Vibrating Screen Separator, issued to Logan et al., assigned to the assignee of the present disclosure, and hereby incorporated in its entirety. In addition to actuators 1007, vibratory separator 1000 may also include a fourth actuator (not shown) to impart a low frequency acceleratory motion, as described above.

Figure 11:
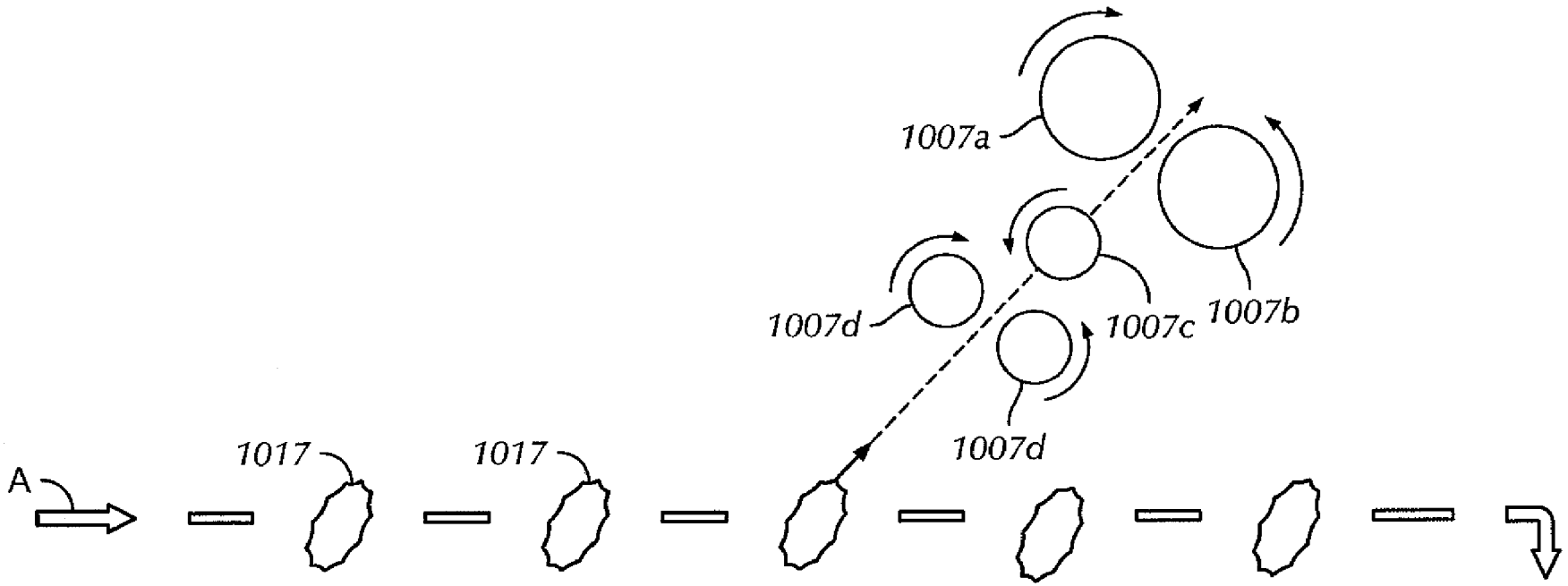
FIG. 11 is a schematic of a high frequency force superimposed over a low frequency force in accordance with an embodiment of the present disclosure.

Referring to FIG. 11, a schematic of a high frequency round force superimposed over a low frequency linear force in accordance with an embodiment of the present disclosure is shown. In this embodiment, actuators 1007*a* and 1007*b* are shown in motion, as described above. The round force applied to the screen assembly is high frequency, and thus relatively constant. However, the acceleratory linear force is low frequency, and thus relatively incremental. Because the centrifugal forces created by the rotation of the unbalanced weights associated with actuator 1007*c* are unopposed, the forces acting alone will impart a generally circular motion to the screen assembly. However, added in combination with actuators 1007*a* and 1007*b*, the resulting motion generated by actuators 1007*a*, 1007*b*, and 1007*c* creates resultant shape 1017.

As actuators 1007*c* rotate, their acceleratory force may be incrementally added to the forces generated by actuators 1007*a* and 1007*b*, thereby resulting in a momentary increase in acceleratory motion. As drilling material is conveyed along a screen assembly in direction A, high frequency round forces constantly shear the drilling material while low frequency linear forces incrementally assist in drilling material conveyance. While the above described embodiments generally describe the low frequency acceleratory motion as linear, one of ordinary skill in the art will appreciate that the low frequency acceleratory motion may be linear, elliptical, or any other type of motion know in the art.

In certain embodiments of the present disclosure a PLC may be included with the vibratory separator to provide instructions for vibratory programs. The instructions may include vibratory programs to provide, for example, a high frequency linear force superimposed over a low frequency linear force, a high frequency linear force superimposed over a low frequency elliptical force, a high frequency elliptical force superimposed over a low frequency linear force, a high frequency elliptical force superimposed over a high frequency linear force, or any other combinations thereof.

Additionally, instructions may be provided to the PLC that allows "on the fly" changing of motion types, so that an operator may select when to engage only a low frequency force, only a high frequency force, or a high frequency force superimposed over a low frequency force. By allowing a range of vibratory programs, an operator may select a type of vibratory scheme that provides a more efficient separatory profile. Additionally, programming instructions may be provided to allow a PLC to automatically adjust the type of force supplied according to a predetermined vibratory separator condition, such as, for example, a time interval and/or a sensed operating condition. Thus, in one embodiment, a PLC may be included that determines and/or calculates operating conditions of a vibratory separator, and adjusts the separatory profile accordingly.

Advantageously, embodiments disclosed herein provide apparatuses and methods for separating drilling fluids and solid drilling material more efficiently. The impartation of a high frequency motion may increase the shearing potential to drilling materials, thereby increasing the quality of processed drilling materials. That is, by increasing the shearing potential, dryer solid cuttings may be produced, and drilling fluid recovery may be increased. By increasing drilling fluid recovery, the cost of a drilling operation may decrease, because less drilling fluid will have to be purchased. Additionally, by producing drying solid cuttings the likelihood of environmental contamination is decreased. Moreover, dryer solid cuttings may decrease the cost of cuttings disposal by decreasing the weight and contamination potential, thereby further decreasing the net cost of the drilling operation.

Also, advantageously, embodiments disclosed herein may provide a faster separatory process that results in higher quality products. By providing a low frequency acceleratory force the speed of drilling material processing may be increased. However, because a high frequency force is superimposed over the low frequency acceleratory force, the shearing potential of the vibratory process may be maintained, thereby potentially resulting in dryer cuttings and increased drilling fluid recovery in a shorter period of time. By decreasing the time associated with processing drilling material, separatory time may be decreased, further decreasing the costs associated with a drilling operation.

Furthermore, high G-forces have the potential to increase vibratory separator wear and decrease the life of screen assemblies. However, embodiments of the present disclosure allow lower intensity high frequency forces with only low frequency increases in G-forces. Thus, the effective life of screen assemblies and vibratory separator component life may be increased, thereby further decreasing costs associated with replacement parts.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed is:

1. A vibratory separator comprising:

a frame including a support member;

a screen configured to connect to the frame; and a plurality of actuators coupled to the support member of the frame;

wherein one or more of the actuators impart a high frequency motion to the frame;

wherein the high frequency motion comprises an elliptical motion;

wherein at least one of the actuators impart a low frequency acceleratory motion to the frame superimposed over the high frequency motion; and wherein the low frequency acceleratory motion comprises one selected from a group consisting of a linear motion, an elliptical motion, and a round motion.

2. The vibratory separator of claim 1, wherein the high frequency motion is imparted to the one or more actuators by a motor at a rate between 3000 and 6000 revolutions per minute.

3. The vibratory separator of claim 1, wherein the low frequency acceleratory motion is imparted to the at least one actuator by a motor at a rate between 900 and 2200 revolutions per minute.

4. The vibratory separator of claim 1, further comprising a programmable logic controller.

5. The vibratory separator of claim 4, wherein the programmable logic controller provides instructions to the vibratory separator for imparting high frequency motion and low frequency acceleratory motion to the frame.

6. The vibratory separator of claim 1, wherein the low frequency acceleratory motion comprises a linear motion.

7. The vibratory separator of claim 1, wherein the low frequency acceleratory motion comprises an elliptical motion.

8. A method for processing drilling waste comprising:

imparting a low frequency acceleratory motion to a frame of a vibratory separator; and imparting a high frequency motion to the frame, the high frequency motion superimposed over the low frequency acceleratory motion;

wherein the low frequency acceleratory motion comprises one selected from a group consisting of a linear motion, an elliptical motion, and a round motion; and wherein the high frequency motion comprises an elliptical motion.

9. The method of claim 8, further comprising injecting drilling waste onto the vibratory separator.

10. The method of claim 8, wherein the low frequency accelerator motion comprises a linear motion.

11. The method of claim 8, wherein the low frequency acceleratory motion comprises an elliptical motion.

12. The method of claim 8, wherein the low frequency acceleratory motion is imparted using a rotary motor.

13. The method of claim 8, wherein the high frequency motion is imparted using a rotary motor.

14. The method of claim 8, further comprising providing instructions to a programmable logic controller configured to the vibratory separator for selecting a separatory profile.

15. The method of claim 14, wherein the separatory profile includes a time interval.

16. A vibratory separator comprising:

a frame including a support member;

a screen configured to connect to the frame; and a plurality of actuators coupled to the support member of the frame;

wherein one or more of the actuators impart a high frequency motion to the frame;

wherein the high frequency motion comprises one selected from a group consisting of a linear motion, an elliptical motion, and a round motion;

wherein at least one of the actuators impart a low frequency acceleratory motion to the frame superimposed over the high frequency motion; and wherein the low frequency acceleratory motion comprises an elliptical motion.

17. The vibratory separator of claim 16, wherein the high frequency motion is imparted to the one or more actuators by a motor at a rate between 3000 and 6000 revolutions per minute.

18. The vibratory separator of claim 16, wherein the low frequency acceleratory motion is imparted to the at least one actuator by a motor at a rate between 900 and 2200 revolutions per minute.

19. A method for processing drilling waste comprising:

imparting a low frequency acceleratory motion to a frame of a vibratory separator; and imparting a high frequency motion to the frame, the high frequency motion superimposed over the low frequency acceleratory motion;

wherein the low frequency acceleratory motion comprises an elliptical motion; and wherein the high frequency motion comprises one selected from a group consisting of a linear motion, an elliptical motion, and a round motion.

20. The method of claim 19, further comprising injecting drilling waste onto the vibratory separator.

21. The method of claim 19, wherein the high frequency motion comprises a round motion.

22. The method of claim 19, wherein the high frequency motion comprises an elliptical motion.

23. The method of claim 19, wherein the low frequency acceleratory motion is imparted using a rotary motor.

24. The method of claim 19, wherein the high frequency motion is imparted using a rotary motor.

25. The method of claim 19, further comprising providing instructions to a programmable logic controller configured to the vibratory separator for selecting a separatory profile.

26. The method of claim 25, wherein the separatory profile includes a time interval.

* * * * *